US010029348B2

(12) United States Patent
Ramirez

(10) Patent No.: US 10,029,348 B2
(45) Date of Patent: Jul. 24, 2018

(54) TORQUE SENSITIVE ADJUSTABLE LOCKING GRINDER GUARD

(71) Applicant: Jose Ramirez, West Jordan, UT (US)

(72) Inventor: Jose Ramirez, West Jordan, UT (US)

( * ) Notice: Subject to any disclaimer, the term of this patent is extended or adjusted under 35 U.S.C. 154(b) by 193 days.

(21) Appl. No.: 15/006,023

(22) Filed: Jan. 25, 2016

(65) Prior Publication Data

US 2017/0209980 A1 Jul. 27, 2017

(51) Int. Cl.
*B24B 55/00* (2006.01)
*B24B 55/05* (2006.01)
*B24B 23/02* (2006.01)

(52) U.S. Cl.
CPC ..... *B24B 55/052* (2013.01); *B24B 55/055* (2013.01); *B24B 23/028* (2013.01)

(58) Field of Classification Search
CPC .... B24B 23/028; B24B 55/052; B24B 55/055
See application file for complete search history.

(56) References Cited

U.S. PATENT DOCUMENTS 4,924,635 A * 5/1990 Rudolf ..... B24B 55/052 451/344
8,523,640 B2 * 9/2013 Esenwein ..... B24B 55/052 451/359
9,475,172 B2 * 10/2016 Cooksey ..... B24B 23/028
2007/0117499 A1 * 5/2007 Chen ..... B24B 23/028 451/451
2010/0105300 A1 * 4/2010 Esenwein ..... B24B 23/028 451/359
2010/0178857 A1 * 7/2010 Esenwein ..... B24B 23/028 451/359
2016/0016285 A1 * 1/2016 Cooksey ..... B24B 55/052 451/359

* cited by examiner

*Primary Examiner* — Timothy V Eley
(74) *Attorney, Agent, or Firm* — Lyman Moulton, Esq.

(57) ABSTRACT

A grinder guard assembly disclosed for a grinder blade includes a rotatable and adjustable indexed grinder guard defining a plurality of indexed and chamfered holes adjacent to an inner ring thereof and an "L" edge configured on an outer circumference thereof to form a guard by retaining grinding debris and preventing outside intervention. The grinder guard assembly also includes an annulus forming a single member with an inside washer and an outside washer and a space there between configured to slidably retain the indexed grinder guard in a common plane with the washers, the annulus configured to axially attach to a hub of the grinder. The grinder guard assembly further includes torque sensitive protrusions mounted from the outside washer, the protrusions configured to lock with the chamfered holes of the indexed grinder guard and retract therefrom based on a torque force applied to the indexed grinder guard relative to the annulus.

20 Claims, 7 Drawing Sheets

SECTION A-A

FIG. 5 SEC. 3A

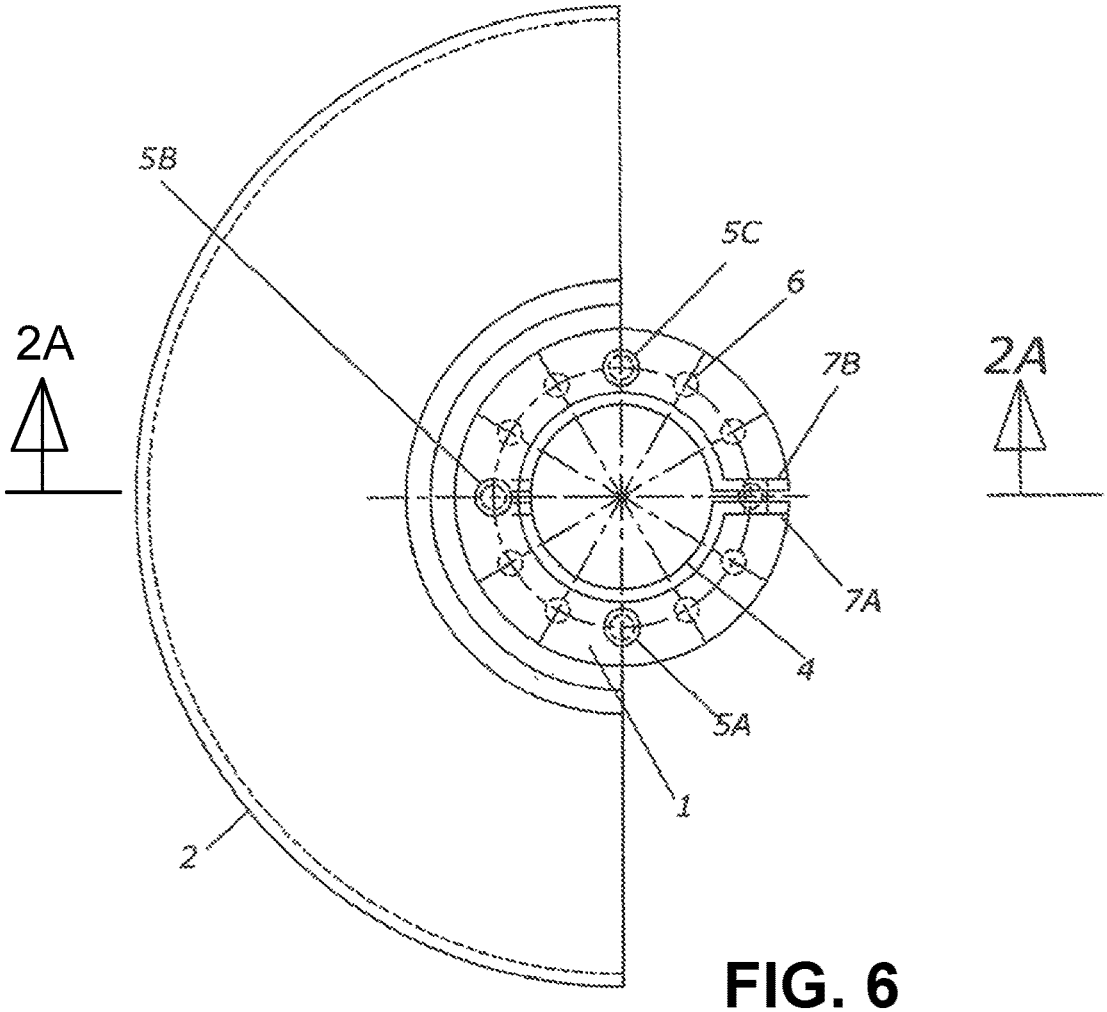
FIG. 6
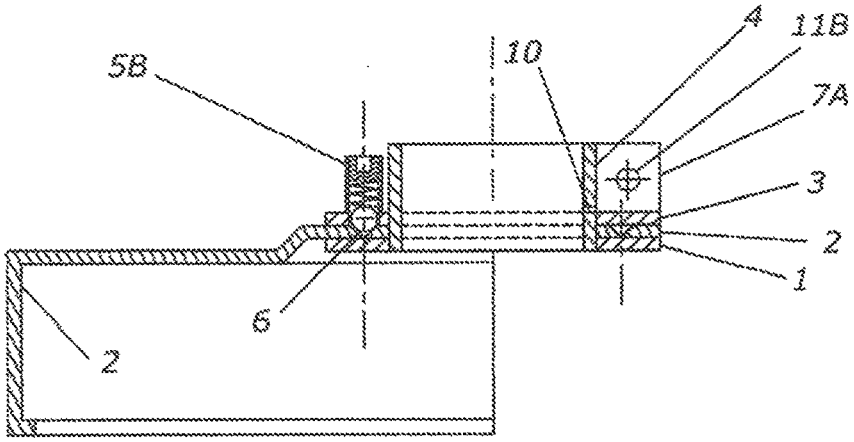
FIG. 7 SEC. 2A

TORQUE SENSITIVE ADJUSTABLE LOCKING GRINDER GUARD

BACKGROUND OF THE INVENTION

Conventional grinder guards are commonly fixed in position or operate on a spring return from a full guard position of a grinder blade to a retractable operating position of the grinder guard. The grinder guard may be pushed aside by an operator's hand or by a workpiece which keeps the guard retracted. However, the spring tension on a retracted grinder guard is felt by the operator as a force against the workpiece which interferes with the operator's craftsmanship. Worse, the spring force against the grinder guard during its retraction can create a temptation by the operator to bypass the guard and hold it fully retracted by his hand or to remove it from the grinder completely to obviate the retracting spring force and an interfering grinder guard all together. Fixed and non-adjustable grinder guards require the operator to get into backward or even dangerous body positions to accomplish certain work.

Some grinder guards therefore present an interference in the operation of the grinder at best and present a grave safety hazard at worst. An operator may have his fingers damaged and cut or even severed by the grinder in attempts to pull the guard out of contact with a work piece. On the other hand, the operator may have dangerous shavings or debris thrown into his or her face and eyes by an unguarded grinder blade or wheel. Not only are there personal risks to unguarded operation but safety restrictions and legal ramifications pursue from OSHA (Operational Safety and Health Administration) and an operator's ability to work for contracts requiring OSHA compliance.

Some conventional grinder guards include limiters configured to put boundaries on how far a grinder guard can retract and therefore allow less spring force and tension to a workpiece. Such limiters help alleviate the before mentioned issues in grinder guards but do not completely alleviate a retracting guard and the issues associated therewith. Therefore, and for other reasons not specifically described herein, there has been a long felt need in the market for a non-retracting grinder guard that does not interfere in an operator's work and craftsmanship.

SUMMARY OF THE INVENTION

A grinder guard assembly is disclosed for a grinder that includes a dialable grinder guard having indexed and chamfered holes adjacent to an inner ring thereof. An "L" edge on a portion of an outer circumference thereof forms a guard by retaining grinding debris and preventing outside intervention. The grinder guard assembly also includes an annulus forming a single member with an inside washer and an outside washer and a space there between configured to slidably retain the indexed grinder guard in a common plane with the washers. The annulus is axially attached to a hub of the grinder. The grinder guard assembly further includes torque sensitive conical pins or bumps mounted from the outside washer. The conical pins or bumps (protrusions) are configured to lock with the chamfered holes of the indexed grinder guard and retract therefrom based a torque on the indexed grinder guard relative to the annulus. The grinder guard assembly therefore adjustably locks into place relative to the grinder and may be dialed into various placements according to a torque force in balance with a spring force or torsion in opposition thereto.

A method for guarding a grinder is also disclosed. The disclosed method includes providing a dialable grinder guard defining a plurality of indexed and chamfered holes adjacent to an inner ring thereof. An "L" edge configured on a portion of an outer circumference thereof forms a guard by retaining grinding debris and preventing outside intervention. The disclosed method additionally includes axially attaching to a hub of the grinder an annulus forming a single member with an inside washer and an outside washer. A space between the washers retains the dialable grinder guard in a common plane with the washers. The disclosed method further includes dialing in a plurality of torque sensitive keepers mounted from the outside washer, the keepers configured to lock with the chamfered holes of the dialable grinder guard and retract therefrom based a torque on the indexed grinder guard relative to the annulus.

Other aspects and advantages of embodiments of the disclosure will become apparent from the following detailed description, taken in conjunction with the accompanying drawings, illustrated by way of example of the principles of the disclosure herein.

BRIEF DESCRIPTION OF THE DRAWINGS

FIG. 5 is a cross sectional view of the offset indexed grinder guard of FIG. 4 depicting the chamfered holes and the "L" guard edge in accordance with an embodiment of the present disclosure.

FIG. 6 is a complete top elevational view of an offset indexed grinder guard depicting the inner ring of chamfered holes in accordance with an embodiment of the present disclosure.

FIG. 7 is a cross sectional view of the offset indexed grinder guard of FIG. 2 depicting the chamfered holes and the "L" guard edge in accordance with an embodiment of the present disclosure.

Figure 1:
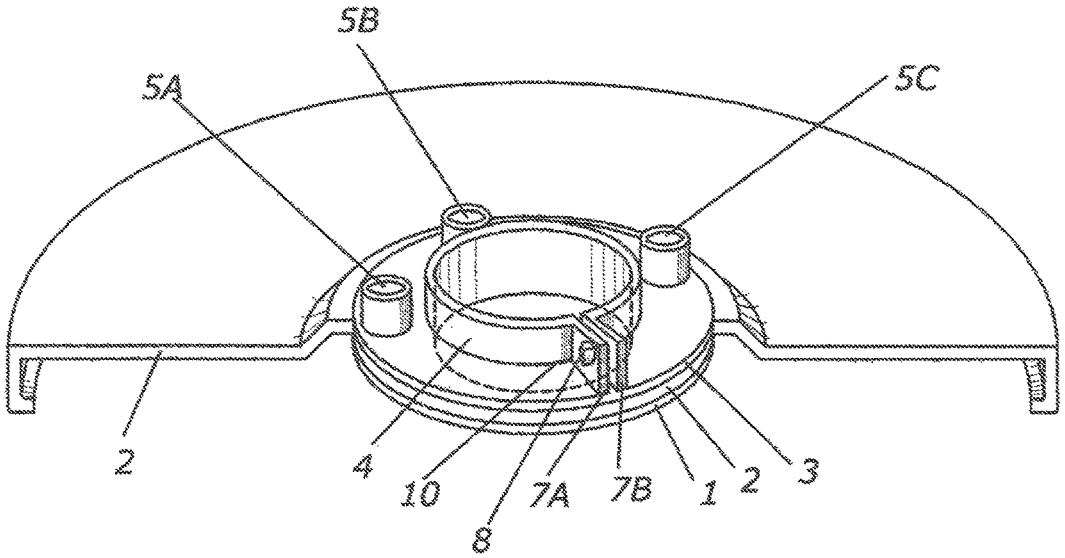
FIG. 1 is a top side orthogonal edge view of an offset torque sensitive adjustable locking grinder guard depicting component members in accordance with an embodiment of the present disclosure.

Throughout the description, similar and same reference numbers may be used to identify similar and same elements in the several embodiments and drawings. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to a person of ordinary skill in the relevant art and having possession of this disclosure, are to be considered within the scope of the invention.

Throughout the present disclosure, the term "torque sensitive" refers to the ability of the disclosure to sense the torque force necessary to twist or turn and dial the grinder guard into a locking position relative to the annulus which is clamped onto a grinder hub. The torque force necessary is just enough to urge the grinder guard from one locked position into another different locked position but also enough to overcome most operating forces on the grinder guard such as resulting from grinding debris and operator bumping motions thereto. Also throughout the present disclosure, the term "adjustable locking" refers to a locking mechanism that allows adjustments to various positions between locking into a semi-temporary placement for operation of a grinder. The grinder referred to in the present disclosure can be a portable handheld unit or it can be a table top fixed unit. The grinder guard assembly and device as disclosed operates and functions in the same and similar manner regardless of the status of the grinder. In fact, the disclosure may be equally and similarly applied to any circular or rotary power tool where protection from debris created by an abrasive wheel or cutting blade is found.

FIG. 1 is a top side orthogonal edge view of an offset torque sensitive adjustable locking grinder guard depicting component members in accordance with an embodiment of the present disclosure. The disclosed grinder guard assembly comprises an inside washer 1, an indexed grinder guard 2, an outside washer 3, an annulus 4, a plurality of torque sensitive protrusions 5*a*, 5*b*, 5*c*, an annulus clamp part 7*a* and part 7*b*, a clamp fastener 8, and a clamping slot 10*a* end and 10*b* end (more clearly illustrated in FIG. 8) defined by the annulus 4 and the outside washer 3. The indexed grinder guard 2 includes an offset portion sloping away from the annulus 4 and the washers 1 and 3 toward the debris retaining circumference described herein as an "L" edge. The sloping offset portion allows for clearance of the annulus 4 and the washers 1 and 3 from a hub of the grinder in some grinder models.

Figure 2:
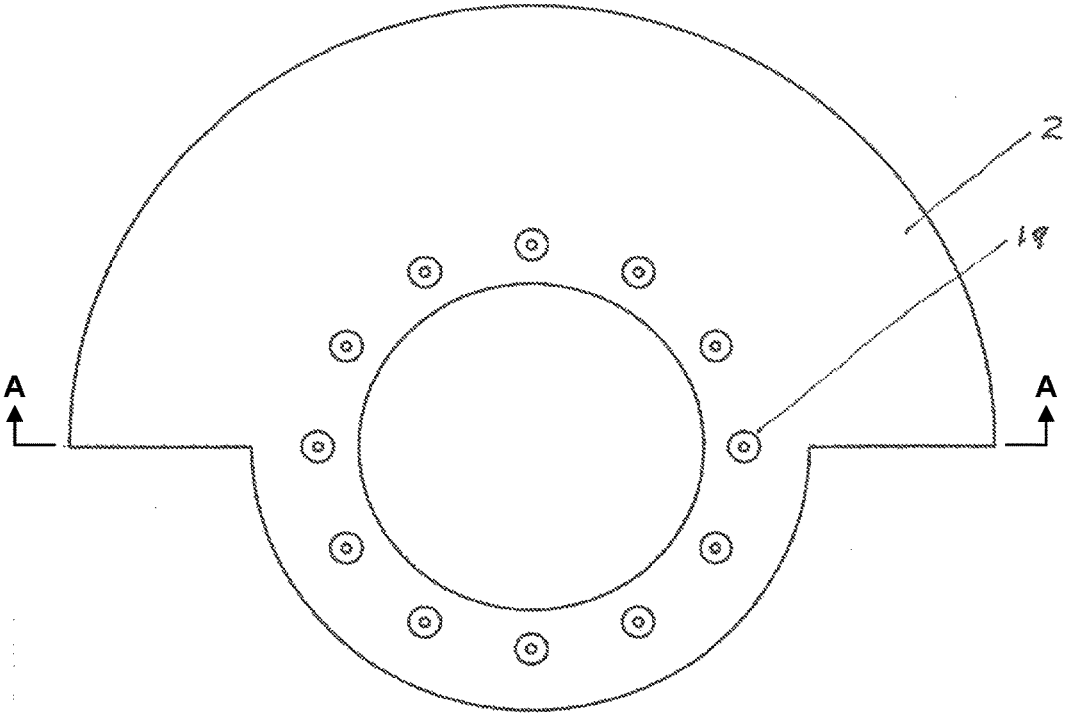
FIG. 2 is a top elevational view of a straight indexed grinder guard depicting the inner ring of chamfered holes in accordance with an embodiment of the present disclosure.

FIG. 2 is an elevational view of an indexed grinder guard depicting the inner ring of chamfered holes in accordance with an embodiment of the present disclosure. A straight grinder guard device as shown comprises a dialable grinder guard 2 defining a plurality of indexed and chamfered holes 19 adjacent to an inner ring thereof and an "L" edge configured on a portion of an outer circumference thereof. This configuration forms a guard by retaining grinding debris and preventing outside intervention. The straight grinder guard device does not require an offset from the inner ring of chamfered holes 19 to the outer circumference as included in other embodiments.

An embodiment of the disclosed grinder guard device is included wherein the torque sensitive keepers comprise a static frictional load against the chamfered holes of the dialable grinder guard 2. The static frictional load is less than a torque applied to the grinder guard relative to the grinder annulus to change a locked position of the grinder guard relative to the grinder. Additionally, or in the alternative, the torque sensitive keepers comprise a spring loaded pin having a spring load less than a torque applied to the grinder guard relative to the grinder annulus to urge a pin out from a locked position in the chamfered hole of the grinder guard.

Figure 3:
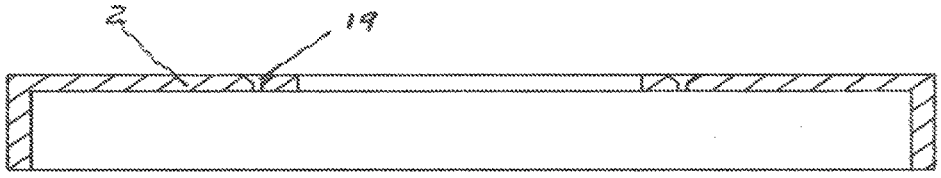
FIG. 3 is a cross sectional view of the straight indexed grinder guard depicting the chamfered holes and the "L" guard edge in accordance with an embodiment of the present disclosure.

FIG. 3 is a cross sectional view of the indexed grinder guard depicting the chamfered holes and the "L" guard edge in accordance with an embodiment of the present disclosure. The grinder guard 2 is shown in cross-hatched lines and two chamfered holes of reference number 19 are depicted therein. The chamfered holes are configured to receive a conical shaped pin in a semi-temporary locking relation against movement in the same plane against the inside washer 1 and the outside washer 3 (not depicted).

Figure 4:
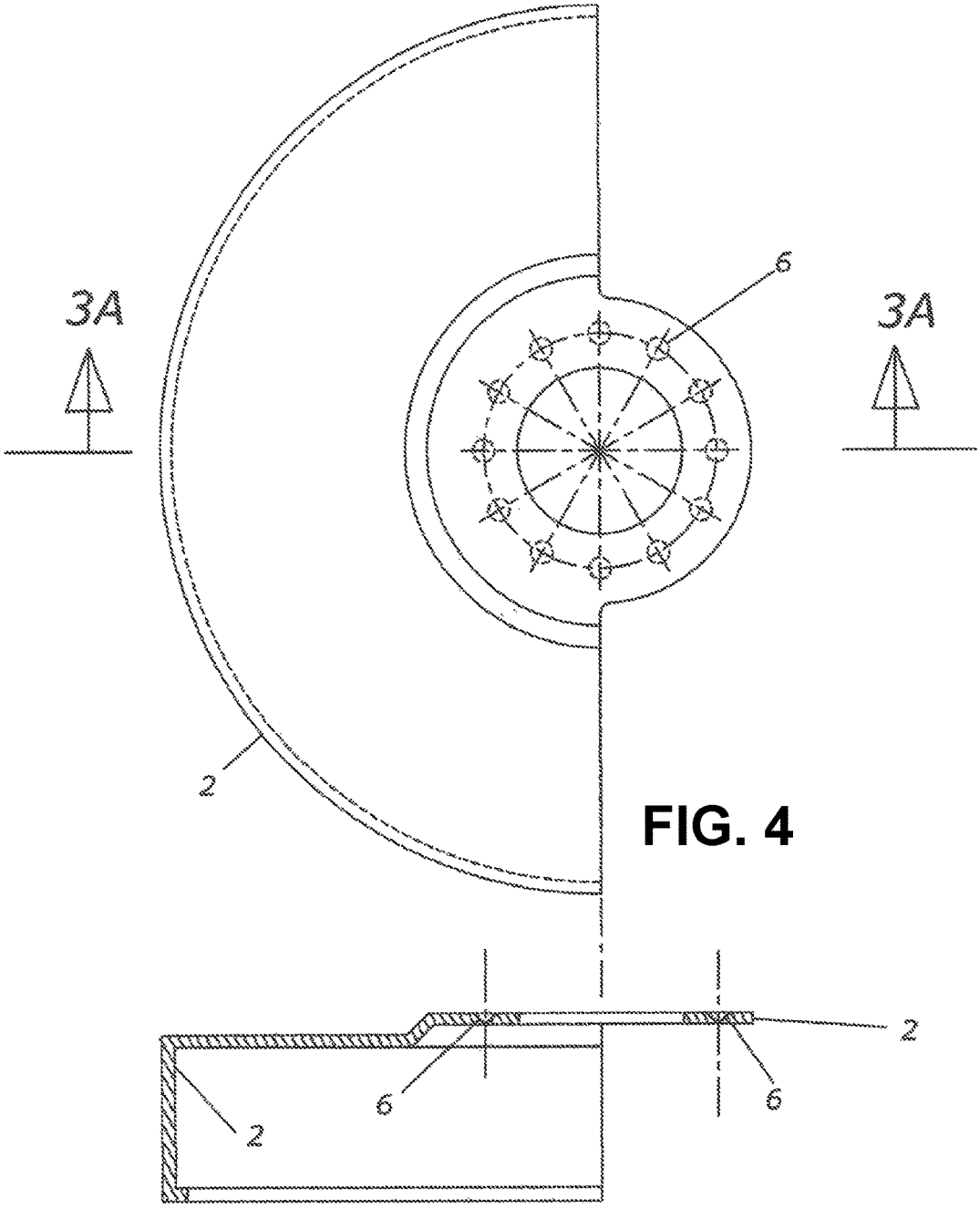
FIG. 4 is a top elevational view of an offset indexed grinder guard depicting the inner ring of chamfered holes in accordance with an embodiment of the present disclosure.

FIG. 4 is a top elevational view of an incomplete offset indexed grinder guard assembly depicting the inner ring of chamfered holes in accordance with an embodiment of the present disclosure. The chamfered holes 6 are shown equidistantly spaced around the inner ring but may also be intermittently spaced on the inner ring according to some embodiments of the disclosure.

FIG. 5 is a cross sectional view of the offset indexed grinder guard of FIG. 4 depicting the chamfered holes and the "L" guard edge in accordance with an embodiment of the disclosure. Reference numbers shown are the same or similar to same and similar components in other embodied drawings disclosed herein. Other reference numbers to components not assembled as shown are also implicitly included. The offset angle and rise and run of the grinder guard thereat are depicted at a 45 degree angle but may also be formed at a right angle and any other angle in between depending on design and tool constraints.

FIG. 6 is a complete top elevational view of an offset indexed grinder guard depicting the inner ring of chamfered holes in accordance with an embodiment of the present disclosure. The disclosed grinder guard device 2 and assembly comprises an annulus 4 forming a single member with an inside washer 1 and an outside washer 3 and a space there between configured to dialably retain the dialable grinder guard assembly in a common plane with the washers. The annulus 4 is configured to axially attach to a hub or a boss of a portable or stationary grinder wheel. The disclosed device further includes a plurality of torque sensitive keepers 5*a*, 5*b* and 5*c* with bumps or conical pins mounted from the washer 3. The keepers lock with the chamfered holes 6 of the dialable grinder guard 2 and retract therefrom based a torque on the grinder guard 2 ring relative to the annulus 4. Other reference numbers are the same or similar to same and similar components in other embodied drawings disclosed herein. The "L" shaped circumferential edge is shown in broken lines near the outside edge of the grinder adjacent reference number 2 as shown.

FIG. 7 is a cross sectional view of the offset indexed grinder guard of FIG. 2 depicting the chamfered holes and the "L" guard edge in accordance with an embodiment of the present disclosure. Reference numbers shown are the same or similar to same and similar components in other embodied drawings disclosed herein. The hole 11*b* defined by the annulus clamp 7*a* and 7*b* (7*b* not shown) is configured to receive the clamp fastener 8 which puts the annulus in a frictional relation to the hub of a grinder. The detail of component 5*b* also known as a torque sensitive locking mechanism is detailed below and includes a conical or a ball bearing component to engage with one of the chamfered holes 6.

Figure 8:
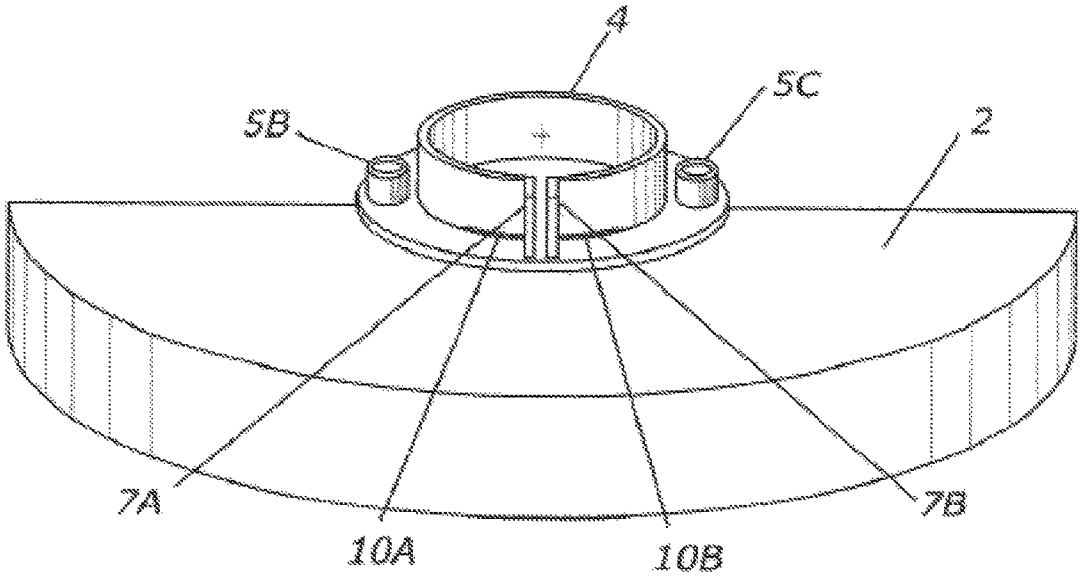
FIG. 8 is a top side orthogonal view of a torque sensitive adjustable locking grinder guard depicting component members in accordance with an embodiment of the present disclosure.

FIG. 8 is a top side orthogonal view of a torque sensitive adjustable locking grinder guard depicting component members in accordance with an embodiment of the disclosure. The grinder guard 2 defines a plurality of indexed and chamfered holes (see also reference number 19) adjacent to an inner ring thereof and an "L" edge configured on a portion of an outer circumference thereof to form a guard by retaining grinding debris and preventing outside intervention. The grinder guard assembly also includes an annulus 4 forming a single member with an inside washer 1 and an outside washer 3 and a space there between configured to slidably retain the indexed grinder guard 2 in a common plane with the washers 1 and 3. The annulus 4 is configured to axially attach to a hub of the grinder (not depicted) as is further explained below. The grinder guard assembly further includes a plurality of torque sensitive protrusions 5*a*, 5*b*, and 5*c* mounted from the outside washer 3. The protrusions are configured to lock with the chamfered holes 19 of the indexed grinder guard 2 and retract therefrom based a torque on the indexed grinder guard 2 relative to the annulus 4 most commonly applied by an operator of the grinder.

An embodiment of the disclosure includes the annulus 4, separated from the washer 3 by a slot between ends 10*a* to 10*b* defined along a portion of the circumference of the annulus 4. The slot is configured to allow a compression of the annulus 4 around the axial hub of the grinder. A clamping device including parts 7*a* and 7*b* on the annulus 4 is separated from the outside washer 3 by the slot ends 10*a* to 10*b*. The clamping device is configured to frictionally and axially attach the annulus on the hub or boss of a grinder based on a mechanical pressure there between derived by the clamping device. The clamping device also comprises two opposing lips 7*a* and 7*b*, one on each of two sides formed in the annulus portion separated from the outside washer by the slot. A screwing fastener adjustably compresses the opposing lips together thus clamping the annulus ring on the hub of the grinder mechanism.

Figure 9:
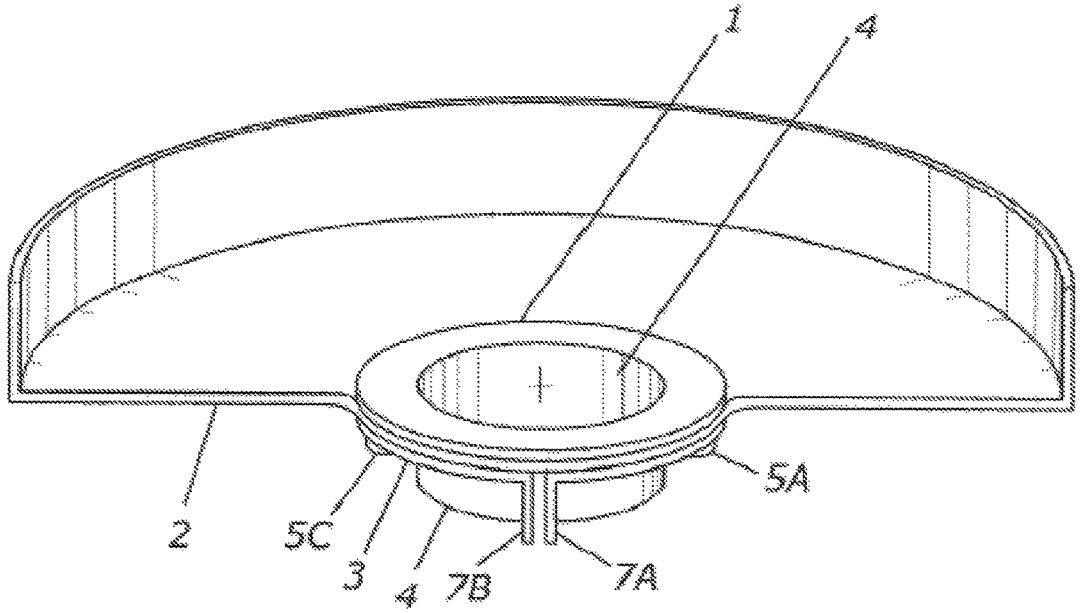
FIG. 9 is a bottom side orthogonal view of a torque sensitive adjustable locking grinder guard depicting component members in accordance with an embodiment of the present disclosure.

FIG. 9 is a bottom side orthogonal view of a torque sensitive adjustable locking grinder guard depicting component members in accordance with an embodiment of the present disclosure. Embodiments of the grinder guard are included wherein the plurality of torque sensitive protrusions including various embodiments, comprise 3 each torque sensitive conical pins spaced equidistantly around the outside washer 3. Also, as many as 12 indexed and chamfered holes are defined equidistantly around the inner ring portion of the grinder guard 2. However, as few as one and any number of pins and corresponding chamfered holes or adjustable keepers are also included in an embodiment of the present disclosure. Additionally, the "L" configured edge of the outer circumference of the grinder guard 2 comprises up to 180 degrees of guard protection.

In an additional embodiment of the disclosure, the torque necessary to move an outer washer protrusion, pin or bump from a chamfered hole of the grinder guard comprises a nominal 10 ft-lbs to 15 ft-lbs torque force on the grinder guard with respect to the grinder annulus and grinder hub, plus or minus a 10% manufacturing tolerance. This torque force is usually provided by the operator of the grinder in order to adjust the guard to a position relative to the grinder that provides him or her the maximum protection from grinder debris. The torque necessary to dial in or adjust the grinder guard 2 into a locked position with respect to the grinder annulus is based on a helical adjustment of the protrusion penetration relative to a chamfered hole in the grinder guard 2. The helical adjustment may be via an adjusting plug or screw which puts pressure directly or indirectly on a protrusion spring or on a torsional relation of the grinder guard to the inside and outside washers 1 and 3. Additionally, the helical adjustment of a spring coil length acting on the protrusion relative to a chamfered hole in the grinder guard varies the torque force on the grinder guard with respect to the grinder annulus and therefore the grinder hub.

Figure 10:
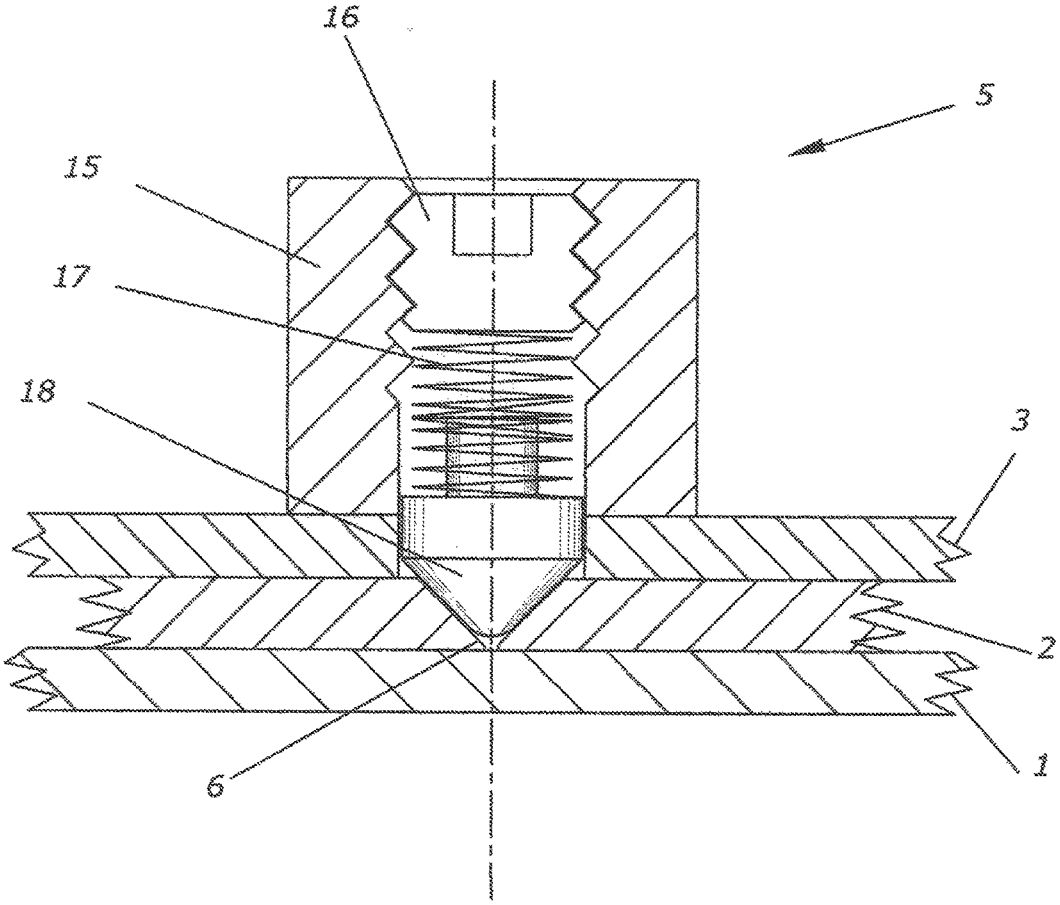
FIG. 10 is a close up view of one of the locking pins of the outside washer in the chamfered holes of the indexed grinder guard in cross section in accordance with an embodiment of the present disclosure.

FIG. 10 is a close up view of the locking pins of the outside washer in the chamfered holes of the indexed grinder guard in cross section in accordance with an embodiment of the present disclosure. FIG. 5 depicts a torque sensitive protrusion 5 including a helical body 15, a helical plug 16, a torque sensitive spring 17, a cone protrusion 18 and a chamfered hole 19. Reference numbers may or may not be the same or similar to reference numbers for other components.

Disclosed in another embodiment of the present disclosure, the torque sensitive protrusions 5 referred also herein as 5*a*, 5*b* and 5*c* comprise a spring loaded cone 18 or pin having a spring load less than a torque applied to the grinder guard 2 relative to the grinder annulus 4 and the grinder to change a locked position of the grinder guard 2 relative to the grinder. Optionally, the torque sensitive protrusions 5 comprise bumps having a static frictional load less than a torque applied to the grinder guard 2 relative to the grinder annulus 4 and the grinder to change a locked position of the grinder guard 2 relative to the grinder and grinder hub. Yet still, the torque sensitive protrusions 5 comprise a spring loaded ball bearing having a spring load less than a torque applied to the grinder guard 2 relative to the grinder annulus 4 and the grinder to change a locked position of the grinder guard 2 relative to the grinder and grinder hub to which the assembly or device is attached. That is, a torque force in the plane of the grinder guard 2 and the washers 1 and 3 urges the cone pin or the ball bearing out of the chamfered hole in the grinder guard so that an operator can dial in a new placement of the grinder guard 2 in the index of holes relative to the annulus 4 for various jobs and needs the operator may have.

The torque force is sufficient to urge the cone pin 18 to retract from the chamfered hole 19. The torque sensitive spring 17 supplies enough counter force to the movement of the cone pin to offset the retracting motion and allow the cone pin to lock into subsequent index chamfered hole based on the operator. Therefore, the static friction between the cone pin and the chamfered hole is overcome by the torque force applied thereto but is subsequently itself overcome by the spring force or spring constant of the torque sensitive spring. This interplay of forces allows a new locking formation in a subsequent chamfered hole chosen by the operator applying the torque force. Therefore, the grinder guard assembly and device is sensitive to a torque force for dialing in a locking position of the grinder guard relative to the annulus clamped on the hub of the grinder.

The spring force enables the dialing and locking motion to occur over and over again. However, the spring constant of the torque sensitive spring is not greater than the force resulting in retracting the cone pin from the chamfered hole in the grinder guard 2. A bump protrusion implementation may draw spring force from the torsional movement of the inside and outside washers against the grinder guard 2. A ball bearing implementation may draw spring force from a torque sensitive spring between the ball bearing in the chamfered hole and the helical plug.

Figure 11:
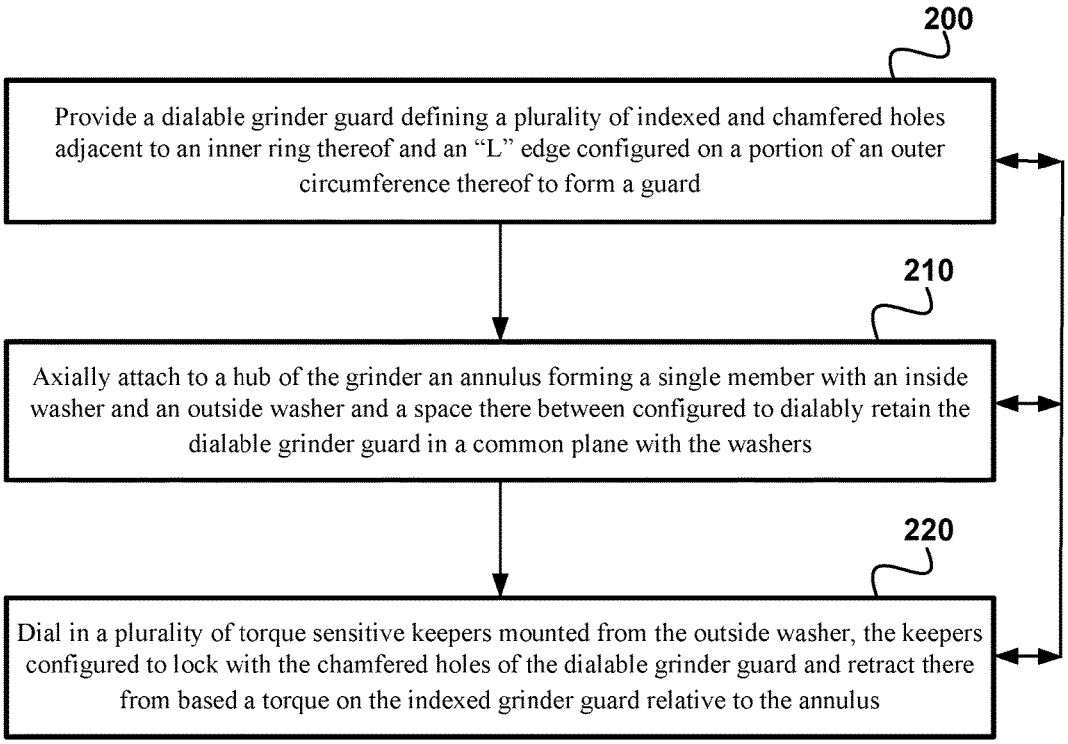
FIG. 11 is a block diagram of a method for guarding a grinder via a torque sensitive locking grinder guard in accordance with an embodiment of the present disclosure.

FIG. 11 is a block diagram of a method for guarding a grinder via a torque sensitive adjustable locking grinder guard in accordance with an embodiment of the present disclosure. A method for guarding a grinder, an abrasive or cutting blade is also disclosed. The disclosed method includes 200 providing a dialable grinder guard defining a plurality of indexed and chamfered holes adjacent to an inner ring thereof and an "L" edge configured on a portion of an outer circumference thereof to form a guard by retaining grinding debris and preventing outside intervention. The disclosed method additionally includes 210 axially attaching to a hub of the grinder an annulus forming a single member with an inside washer and an outside washer and a space there between configured to dialably retain the dialable grinder guard in a common plane with the washers. The disclosed method further includes 220 dialing in a plurality of torque sensitive keepers mounted from the outside washer, the keepers configured to lock with the chamfered holes of the dialable grinder guard and retract therefrom based a torque on the indexed grinder guard relative to the annulus.

An embodiment of the disclosed method for guarding a grinder comprises urging a torque sensitive keeper, having a spring load less than a torque applied to the grinder guard relative to the grinder annulus and the grinder, out from a locked position in the chamfered hole of the grinder guard. The embodied method may further comprise clamping the annulus around the axial hub of the grinder via a separating slot defined between the outside washer along a portion of the circumference of the annulus, the slot configured to allow a compression of the annulus around the axial hub of the grinder.

The non-obvious and novel features and advantages of the present disclosure are not limited to a handheld or table top grinder, abrasive blades or circular saws but may also be used in other types of rotary tools for piping, commercial and residential construction and the like. The present disclosure satisfies the long felt need in the market place for an adjustable yet locking grinder guard. The present disclosure is very portable, can be small or large, is effective and easy to use and only requires a reasonable torque force relative to a fixed grinding reference. It may be used for large volume industrial piping or in the field where it is more practical to carry a hand held grinder.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Notwithstanding specific embodiments of the invention have been described and illustrated, the invention is not to be limited to the specific forms or arrangements of parts so described and illustrated. The scope of the invention is to be defined by the claims and their equivalents included herein or by reference to a related application.

What is claimed is:

1. A grinder guard assembly for a grinder, the grinder guard assembly comprising:

an indexed grinder guard defining a plurality of indexed and chamfered holes adjacent to an inner ring thereof and an "L" edge configured on a portion of an outer circumference thereof to form a guard by retaining grinding debris and preventing outside intervention;

an annulus forming a single member with an inside washer and an outside washer and a space there between configured to slidably retain the indexed grinder guard in a common plane with the washers, the annulus configured to axially attach to a hub of the grinder; and a plurality of torque sensitive conical protrusions mounted from the outside washer, the torque sensitive conical protrusions configured to lock with the indexed and chamfered holes of the indexed grinder guard and to retract therefrom based on a torque force on the indexed grinder guard relative to the annulus.

2. The grinder guard of claim 1, wherein the annulus is separated from the outside washer by a slot defined there between along a portion of the circumference of the annulus, the slot configured to allow a compression of the annulus around the hub of the grinder.

3. The grinder guard of claim 2, further comprising a clamping device on the annulus separated from the outside washer by the slot, the clamping device configured to frictionally attach the annulus on the axial hub of the grinder based on a mechanical pressure there between derived by the clamping device.

4. The grinder guard of claim 3, wherein the clamping device comprises two opposing lips, one on each of two sides formed in the annulus portion separated from the outside washer by the slot and a screwing fastener configured to adjustably compress the opposing lips together.

5. The grinder guard of claim 1, wherein the torque sensitive conical protrusions comprise one of a spring load and a spring force greater than a retracting force component of a torque applied to the grinder guard relative to the grinder annulus and the grinder to change a locked position of the grinder guard relative to the grinder.

6. The grinder guard of claim 1, wherein the torque sensitive conical protrusions comprise bumps having a static frictional force less than a torque force applied to the grinder guard relative to the grinder annulus and the grinder to change a locked position of the grinder guard relative to the grinder.

7. The grinder guard of claim 1, wherein the torque sensitive protrusions each comprise a spring loaded ball bearing having a spring adjustable resisting force less than a torque load applied to the grinder guard relative to the grinder annulus and the grinder to change a locked position of the grinder guard relative to the grinder.

8. The grinder guard of claim 1, wherein the plurality of torque sensitive conical protrusions comprise 2 or more torque sensitive conical protrusions spaced equidistantly and randomly around the outside washer.

9. The grinder guard of claim 1, wherein the plurality of indexed and chamfered holes comprise as many as 12 or more indexed and chamfered holes indexed equidistantly and randomly around the inner ring portion of the grinder guard.

10. The grinder guard of claim 1, wherein the "L" configured edge of the outer circumference of the grinder guard comprises a minimum of 180 degrees of grinder guard circumference.

11. The grinder guard of claim 1, wherein the torque necessary to move a protrusion from a chamfered hole of the grinder guard comprises an adjustable 10 ft-lbs to 15 ft-lbs nominal torque force on the grinder guard with respect to the grinder annulus and grinder hub, plus a 10% manufacturing tolerance.

12. The grinder guard of claim 1, wherein the torque necessary to move an outer washer protrusion from a chamfered hole of the grinder guard comprises an adjustable torque force on the grinder guard with respect to the grinder annulus and grinder hub based on a helical adjustment of the protrusion penetration relative to a chamfered hole in the grinder guard.

13. The grinder guard of claim 1, wherein the torque necessary to move an outer washer protrusion from a chamfered hole of the grinder guard comprises an adjustable torque force on the grinder guard with respect to the grinder annulus and grinder hub based on a helical adjustment of a spring coil length acting on the protrusion relative to a chamfered hole in the grinder guard.

14. A grinder guard device, comprising:

a dialable grinder guard defining a plurality of indexed and chamfered holes adjacent to an inner ring thereof and an "L" edge configured on a portion of an outer circumference thereof to form a guard by retaining grinding debris and preventing outside intervention;

an annulus forming a single member with an inside washer and an outside washer and a space there between configured to dialably retain the dialable grinder guard in a common plane with the washers, the annulus configured to axially attach to a hub of the grinder; and a plurality of torque sensitive keepers mounted from the outside washer, the torque sensitive keepers configured to lock with the chamfered holes of the dialable grinder guard and retract therefrom based on a torque on the indexed grinder guard relative to the annulus.

15. The grinder guard device of claim 14, wherein the torque sensitive keepers comprise a static frictional load against the chamfered holes of the dialable grinder guard less than a torque applied to the grinder guard relative to the grinder annulus and the grinder to change a locked position of the grinder guard relative to the grinder.

16. The grinder guard device of claim 14, wherein the torque sensitive keepers comprise a spring loaded pin having a spring adjustable resisting force less than a torque force applied to the grinder guard relative to the grinder annulus and the grinder to urge a pin out from a locked position in the chamfered hole of the grinder guard.

17. The grinder guard device of claim 14, wherein the annulus is separated from the outside washers by a slot defined there between and along a portion of the circumference of the annulus, the slot configured to allow a compression of the annulus around the axial hub of the grinder.

18. A method for guarding a grinder blade, comprising:

providing a dialable grinder guard defining a plurality of indexed and chamfered holes adjacent to an inner ring thereof and an "L" edge configured on an outer circumference thereof to form a guard by retaining grinding debris and preventing outside intervention;

axially attaching to a hub of the grinder an annulus forming a single member with an inside washer and an outside washer and a space there between configured to dialably retain the dialable grinder guard in a common plane with the washers; and dialing in at least one torque sensitive keeper mounted from the outside washer, the at least one torque sensitive keeper configured to lock with the chamfered holes of the dialable grinder guard and retract therefrom based a torque force on the indexed grinder guard relative to the annulus.

19. The method for guarding a grinder of claim 18, further comprising urging a torque sensitive keeper, having a spring adjustable force less than a torque force applied to the grinder guard relative to the grinder annulus and the grinder, out from a locked position in one of the indexed and chamfered holes of the grinder guard.

20. The method for guarding a grinder of claim 18, further comprising clamping the annulus around the axial hub of the grinder via a separating slot defined between the inside washer and the outside washer along a portion of the circumference of the annulus, the slot configured to allow a compression of the annulus around the axial hub of the grinder.

* * * * *